US007068748B2

(12) United States Patent
Singh

(10) Patent No.: US 7,068,748 B2
(45) Date of Patent: Jun. 27, 2006

(54) UNDERGROUND SYSTEM AND APPARATUS FOR STORING SPENT NUCLEAR FUEL

(75) Inventor: Krishna Singh, Palm Harbor, FL (US)

(73) Assignee: Holtec International, Inx., Marlton, NJ (US)

( * ) Notice: Subject to any disclaimer, the term of this patent is extended or adjusted under 35 U.S.C. 154(b) by 0 days.

(21) Appl. No.: 10/803,620

(22) Filed: Mar. 18, 2004

(65) Prior Publication Data

US 2005/0207525 A1 Sep. 22, 2005

(51) Int. Cl.
*G21C 19/00* (2006.01)

(52) U.S. Cl. ..... 376/272; 250/515.1; 250/506.1

(58) Field of Classification Search ..... 376/272, 376/273, 347; 250/506.1, 507.1, 515.1
See application file for complete search history.

(56) References Cited

U.S. PATENT DOCUMENTS 3,111,078 A * 11/1963 Breckenridge ..... 454/194
3,111,586 A * 11/1963 Rogers ..... 250/507.1
3,629,062 A 12/1971 Muenchow
3,739,451 A 6/1973 Jacobson
3,745,707 A 7/1973 Herr
3,755,079 A 8/1973 Wesinstein et al.
3,765,549 A 10/1973 Jones
3,800,973 A 4/1974 Weaver
3,836,267 A 9/1974 Schatz
3,910,006 A 10/1975 James
3,917,953 A 11/1975 Wodrich
3,935,062 A 1/1976 Keller et al.
3,945,509 A 3/1976 Weems
3,962,587 A 6/1976 Dufrane et al.
3,984,942 A 10/1976 Schroth
4,055,508 A 10/1977 Yoli et al.
4,078,968 A 3/1978 Golden et al.
4,158,599 A 6/1979 Andrews et al.
4,278,892 A 7/1981 Baatz et al.
4,288,698 A 9/1981 Baatz et al.
4,336,460 A 6/1982 Best et al.
4,355,000 A 10/1982 Lumelleau
4,356,146 A * 10/1982 Knappe et al. ..... 376/272
4,366,095 A 12/1982 Takats et al.
4,394,022 A 7/1983 Gilmore
4,450,134 A 5/1984 Soot et al.
4,498,011 A 2/1985 Dyck et al.
4,526,344 A 7/1985 Oswald et al.
4,527,066 A 7/1985 Dyck et al.

(Continued)

FOREIGN PATENT DOCUMENTS

DE 2821780 A1 11/1979

(Continued)

*Primary Examiner*—Ricardo J. Palabrica
(74) *Attorney, Agent, or Firm*—Brian L. Belles; Wolf, Block, Shorr & Solis-Cohen

(57) ABSTRACT

A system and method for storing spent nuclear fuel below grade that affords adequate ventilation of the spent fuel storage cavity. In one aspect, the invention is a system comprising: a body having a cavity for receiving and storing a spent fuel canister, a major portion of the body positioned below grade; the body having at least one inlet ventilation duct extending from an above grade inlet to a below grade outlet in the cavity. The inlet ventilation duct can be a en elongated substantially S-shape extending from a side wall of the body to the bottom of the cavity. In another aspect, the invention is a method of storing a spent fuel canister using the system.

35 Claims, 5 Drawing Sheets

U.S. PATENT DOCUMENTS

| | | | | |
|---|---|---|---|---|
| 4,585,611 | A | 4/1986 | Perl | |
| 4,634,875 | A * | 1/1987 | Kugeler et al. | 250/506.1 |
| 4,635,477 | A | 1/1987 | Simon | |
| 4,649,018 | A * | 3/1987 | Waltersdorf et al. | 376/272 |
| 4,663,533 | A * | 5/1987 | Kok et al. | 250/506.1 |
| 4,671,326 | A | 6/1987 | Wilhelm | |
| 4,690,795 | A | 9/1987 | Hardin et al. | |
| 4,764,333 | A | 8/1988 | Minshall et al. | |
| 4,780,269 | A | 10/1988 | Fischer et al. | |
| 4,800,062 | A | 1/1989 | Craig et al. | |
| 4,834,916 | A * | 5/1989 | Chaudon et al. | 376/272 |
| 4,847,009 | A | 7/1989 | Madle et al. | |
| 4,851,183 | A * | 7/1989 | Hampel | 376/274 |
| 4,971,752 | A * | 11/1990 | Parker | 376/274 |
| 5,102,615 | A | 4/1992 | Grande et al. | |
| 5,182,076 | A | 1/1993 | de Seroux et al. | |
| 5,267,280 | A | 11/1993 | Dequesne | |
| 5,297,917 | A | 3/1994 | Freneix | |
| 5,307,388 | A * | 4/1994 | Inkester et al. | 376/272 |
| 5,319,686 | A | 6/1994 | Pizzano et al. | |
| 5,387,741 | A | 2/1995 | Shuttle | |
| 5,469,936 | A | 11/1995 | Lauga et al. | |
| 5,513,231 | A | 4/1996 | Jones et al. | |
| 5,513,232 | A | 4/1996 | Jones et al. | |
| 5,546,436 | A | 8/1996 | Jones et al. | |
| 5,564,498 | A | 10/1996 | Bochard | |
| 5,633,904 | A | 5/1997 | Gilligan et al. | |
| 5,646,971 | A | 7/1997 | Howe | |
| 5,661,768 | A | 8/1997 | Gilligan et al. | |
| 5,753,925 | A * | 5/1998 | Yamanaka et al. | 250/507.1 |
| 5,771,265 | A * | 6/1998 | Montazer | 376/272 |
| 5,862,195 | A | 1/1999 | Peterson | |
| 6,064,710 | A | 5/2000 | Singh | |
| 6,252,923 | B1 | 6/2001 | Iacovino et al. | |
| 6,519,307 | B1 * | 2/2003 | Singh et al. | 376/272 |
| 6,718,000 | B1 * | 4/2004 | Singh et al. | 376/272 |

FOREIGN PATENT DOCUMENTS

| | | | |
|---|---|---|---|
| DE | 3107158 | A1 | 1/1983 |
| DE | 3144113 | | 5/1983 |
| DE | 3151475 | A1 | 5/1983 |
| DE | 3404666 | | 8/1985 |
| DE | 3515871 | | 11/1986 |
| DE | 195 29 357 | A1 | 8/1995 |
| EP | 0253730 | | 1/1988 |
| EP | 1 061 011 | A1 | 6/2000 |
| FR | 2434463 | | 8/1979 |
| GB | 2295484 | A | 5/1996 |
| GB | 2327722 | | 1/1999 |
| JP | 62-1851999 | | 8/1987 |
| RU | 2168022 | C * | 6/2000 |

* cited by examiner

UNDERGROUND SYSTEM AND APPARATUS FOR STORING SPENT NUCLEAR FUEL

FIELD OF THE INVENTION

The present invention related generally to the field of storing spent nuclear fuel, and specifically to systems and methods for storing spent nuclear fuel in ventilated vertical modules.

BACKGROUND OF THE INVENTION

In the operation of nuclear reactors, it is customary to remove fuel assemblies after their energy has been depleted down to a predetermined level. Upon removal, this spent nuclear fuel is still highly radioactive and produces considerable heat, requiring that great care be taken in its packaging, transporting, and storing. In order to protect the environment from radiation exposure, spent nuclear fuel is first placed in a canister. The loaded canister is then transported and stored in large cylindrical containers called casks. A transfer cask is used to transport spent nuclear fuel from location to location while a storage cask is used to store spent nuclear fuel for a determined period of time.

In a typical nuclear power plant, spent nuclear fuel is loaded into a canister while submerged in a pool of water. The canister is sealed and loaded into a transfer cask while still submerged in the pool. Once loaded with the canister, the transfer cask is used to transport the canister to a storage cask. The loaded canister is then transferred from the transfer cask to the storage cask for long term storage. During transfer from the transfer cask to the storage cask, it is imperative that the loaded canister is not exposed to the environment.

One type of storage cask is a ventilated vertical overpack ("VVO"). A VVO is a massive structure made principally from steel and concrete and is used to store a canister loaded with spent nuclear fuel. VVOs stand above ground and are typically cylindrical in shape and extremely heavy, weighing over 150 tons and often having a height greater than 16 feet. VVOs typically have a flat bottom, a cylindrical body having a cavity to receive a canister of spent nuclear fuel, and a removable top lid.

In using a VVO to store spent nuclear fuel, a canister loaded with spent nuclear fuel is placed in the cavity of the cylindrical body of the VVO. Because the spent nuclear fuel is still producing a considerable amount of heat when it is placed in the VVO for storage, it is necessary that this heat energy have a means to escape from the VVO cavity. This heat energy is removed from the outside surface of the canister by ventilating the VvO cavity. In ventilating the VVO cavity, cool air enters the VVO chamber through bottom ventilation ducts, flows upward past the loaded canister, and exits the VvO at an elevated temperature through top ventilation ducts. The bottom and top ventilation ducts of existing VVOs are located circumferentially near the bottom and top of the VVO's cylindrical body respectively, as illustrated in FIG. 1.

While it is necessary that the VVO cavity be vented so that heat can escape from the canister, it is also imperative that VVO provide adequate radiation shielding and that the spent nuclear fuel not be directly exposed to the external environment. The inlet duct located near the bottom of the overpack is a particularly vulnerable source of radiation exposure to security and surveillance personnel who, in order to monitor the loaded overpacks, must place themselves in close vicinity of the ducts for short durations.

Additionally, when a canister loaded with spent nuclear fuel is transferred from a radiation pool to a storage VVO, a transfer cask is stacked atop the storageVVO so that the canister can be lowered into the storage VVO's cavity. Most casks are very large structures and can weigh up to 250,000 lbs. and have a height of 16 ft. or more. Stacking a transfer cask atop a storage cask requires a lot of space, a large overhead crane, and possibly a restraint system for stabilization. Often, such space is not available inside a nuclear power plant. Finally, the above ground storage overpacks stand at least 16 feet above ground and thus present a sizable target of attack to a terrorist.

DISCLOSURE OF THE PRESENT INVENTION

It is an object of the present invention is to provide a system and method for storing spent nuclear fuel that reduces the height of the stack assembly when a transfer cask is stacked atop a storage VVO.

It is another object of the present invention is to provide a system and method for storing spent nuclear fuel that requires less vertical space.

Yet another object of the present invention is to provide a system and method for storing spent nuclear fuel that utilizes the radiation shielding properties of the subgrade during storage while providing adequate ventilation of the spent nuclear fuel.

A further object of the present invention is to provide a system and method for storing spent nuclear fuel that provides the same or greater level of operational safeguards that are available inside a fully certified nuclear power plant structure.

A still further object of the present invention is to provide a system and method for storing spent nuclear fuel that decreases the dangers presented by earthquakes and other catastrophic events and virtually eliminates the potential damage from a World Trade Center or Pentagon type of attack on the stored canister.

It is also an object of the present invention is to provide a system and method for storing spent nuclear fuel that allows an ergonomic transfer of the spent nuclear fuel from a transfer cask to a storage VVO.

Still another object of the present invention is to provide a system and method for storing spent nuclear fuel below grade.

Yet another object of the present invention is to provide a system and method of storing spent nuclear fuel that reduces the amount of radiation emitted to the environment.

These and other objects are met by the present invention which in one aspect is a system for storing spent-nuclear fuel comprising: a body having a cavity for receiving and storing a spent fuel canister, a major portion of the body positioned below grade; the body having at least one inlet ventilation duct extending from an above grade inlet to a below grade outlet in the cavity. By providing an inlet ventilation duct in the body that extends from above grade to the cavity at a point below grade, the radiation shielding properties of the subgrade can be utilized for the spent fuel canister without obstructing the ventilation of the canister in the cavity. When loaded with a hot spent fuel canister, the cool ambient air will enter the above grade inlet, travel through the inlet ventilation duct, and enter the cavity preferably, at or near its bottom. Heat from the spent fuel will warm the cool air causing it to rise within the cavity. The heated air will then exit the cavity via an outlet ventilation duct located in either a lid or in an above grade portion of the body. Thus, below grade storage of the spent nuclear fuel canister is facilitated while affording adequate heat ventilation for a spent fuel canister placed in the cavity.

Preferably, the above grade inlet of the inlet ventilation duct is in a side wall of the body. When the above grade inlet is in the side wall of the body, the inlet ventilation duct can be an elongated substantially S-shape. In order to provide sufficient ventilation, it is preferred that two inlet ventilation ducts be provided in the body in opposing side walls of the body. Vent screens are preferably provided to cover the above grade inlets of the inlet ventilation ducts.

The body is preferably constructed of concrete and the cavity and the ventilation duct are insulated from the body to both prevent the body from becoming heated beyond FSAR limits and to prevent the cold air entering the ventilation duct from becoming heated before it enters the cavity. The ventilation duct and the cavity are preferably built to be an integral piece that is hermetically sealed, preventing the ingress of below grade liquids. This reduces the possibility of corrosion of the internals of the cavity. In this embodiment, a steel shell is provided to line the cavity and the inlet ventilation duct is constructed of steel. The shell and the inlet ventilation duct are welded together to achieve the hermetic seal. A bottom plate that is also integral to the shell and the inlet ventilation duct can be provided below the cavity. The system can also comprise a base on which the body is positioned, such as a concrete slab.

The system can also have support blocks on the bottom surface of the cavity. Preferably, these support blocks will be circumferentially spaced apart and provide an air plenum between a canister of spent nuclear fuel and the bottom surface of the cavity when the canister is placed in the cavity for storage. The existence of the air plenum will help facilitate optimal ventilation of the cavity. The support blocks can be made of low carbon steel.

During the storage of a spent fuel canister, the system will preferably further comprise a lid positioned atop the body and covering the cavity. Preferably, when a spent fuel canister is positioned in the cavity and the lid is placed atop the body enclosing the cavity, an air plenum exists between the canister and the lid. It is also preferable that the lid comprises a shear ring that protrudes into the cavity when the lid is positioned atop the body. The shear ring provides enormous shear resistance against lateral forces from earthquakes, impactive missiles, or other projectiles, thus, maintaining the radiation shielding integrity of the system.

The lid also preferably comprises at least one outlet ventilation duct for allowing heated air to exit the cavity. This outlet ventilation duct can be a horizontal passageway in a side wall of the lid. In this embodiment, the outlet ventilation ducts in the lid are circumferentially and azimuthally separated from the above grade inlet of the inlet ventilation ducts in the body. This helps prevent the heated air that is exiting the cavity from the lid being drawn back into the inlet ventilation ducts in the body and back into the cavity.

It is preferred that the body extend from approximately 6 inches to 36 inches above grade and that the a major portion of the cavity's height be below grade so that when a spent fuel canister is lowered into the cavity, at least a major portion of the canister is below grade.

In another aspect, the invention is a method of storing spent nuclear fuel comprising: providing the system described above; lowering a spent fuel canister into the cavity so that a major portion of the canister is below grade; and placing a lid atop the body so as to enclose the cavity, the lid having at least one outlet ventilation duct for allowing heated air to exit the cavity; wherein ventilation of the canister is provided by cold air entering the cavity through the inlet ventilation duct in the body, the cold air being heated within the cavity by the spent nuclear fuel, and warm air exiting the cavity through the outlet ventilation duct in the lid. The system used to perform the method of the present invention can contain any of the specific aspects discussed above.

DETAILED DESCRIPTION OF THE DRAWINGS

Figure 1:
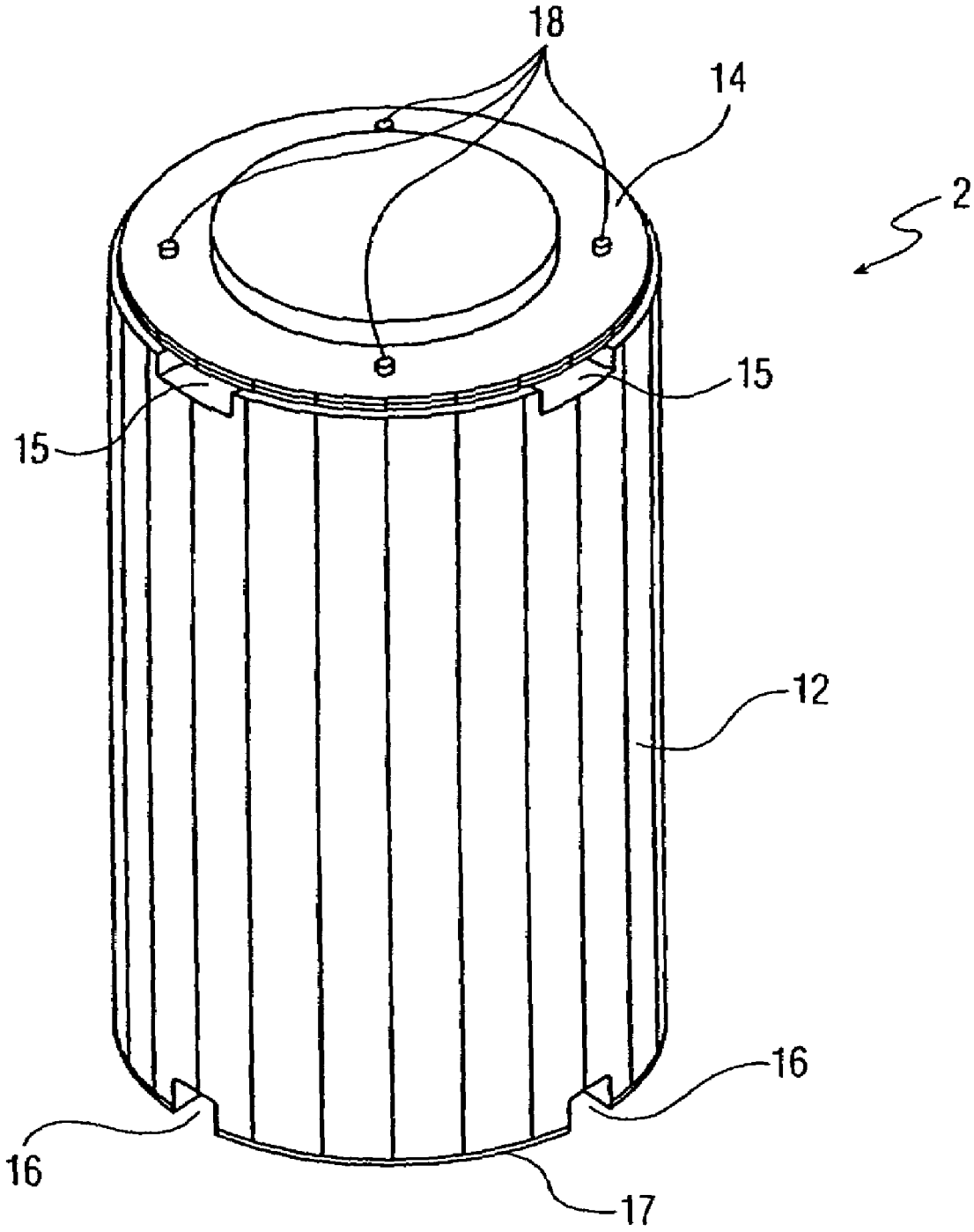
FIG. 1 PRIOR ART
FIG. 1 is a perspective view of a prior art VVO.

FIG. 1 illustrates prior art ventilated vertical overpack ("VVO") 2. Prior art VVO 2 comprises flat bottom 17, cylindrical body 12, and lid 14. Lid 14 is secured to cylindrical body 12 by bolts 18. Bolts 18 also serve to restrain lateral sliding of lid 14 with respect to cylindrical body 12 if prior art VVO 2 were to tip over. Cylindrical body 12 has top ventilation ducts 15 and bottom ventilation ducts 16. Top ventilation ducts 15 are located at or near the top of cylindrical body 12 while bottom ventilation ducts 16 are located at or near the bottom of cylindrical body 12. Both bottom ventilation ducts 16 and top ventilation ducts 15 are located around the circumference of the cylindrical body 12. The entirety of prior art VVO 2 is positioned above grade.

Figure 2:
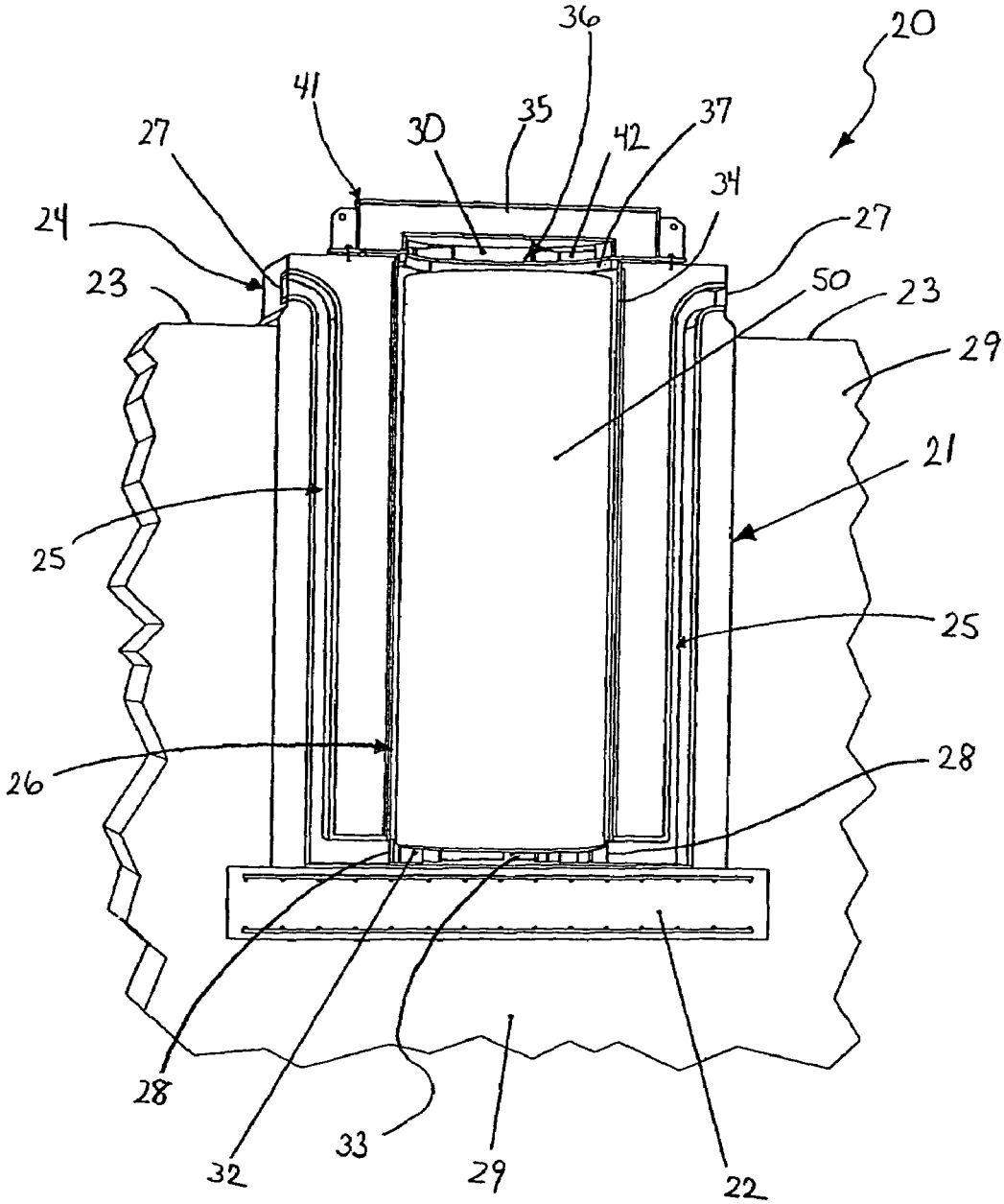
FIG. 2 is a side cross sectional view of an underground VVO according to an embodiment of the present invention having a spent fuel canister positioned therein.
Figure 3:
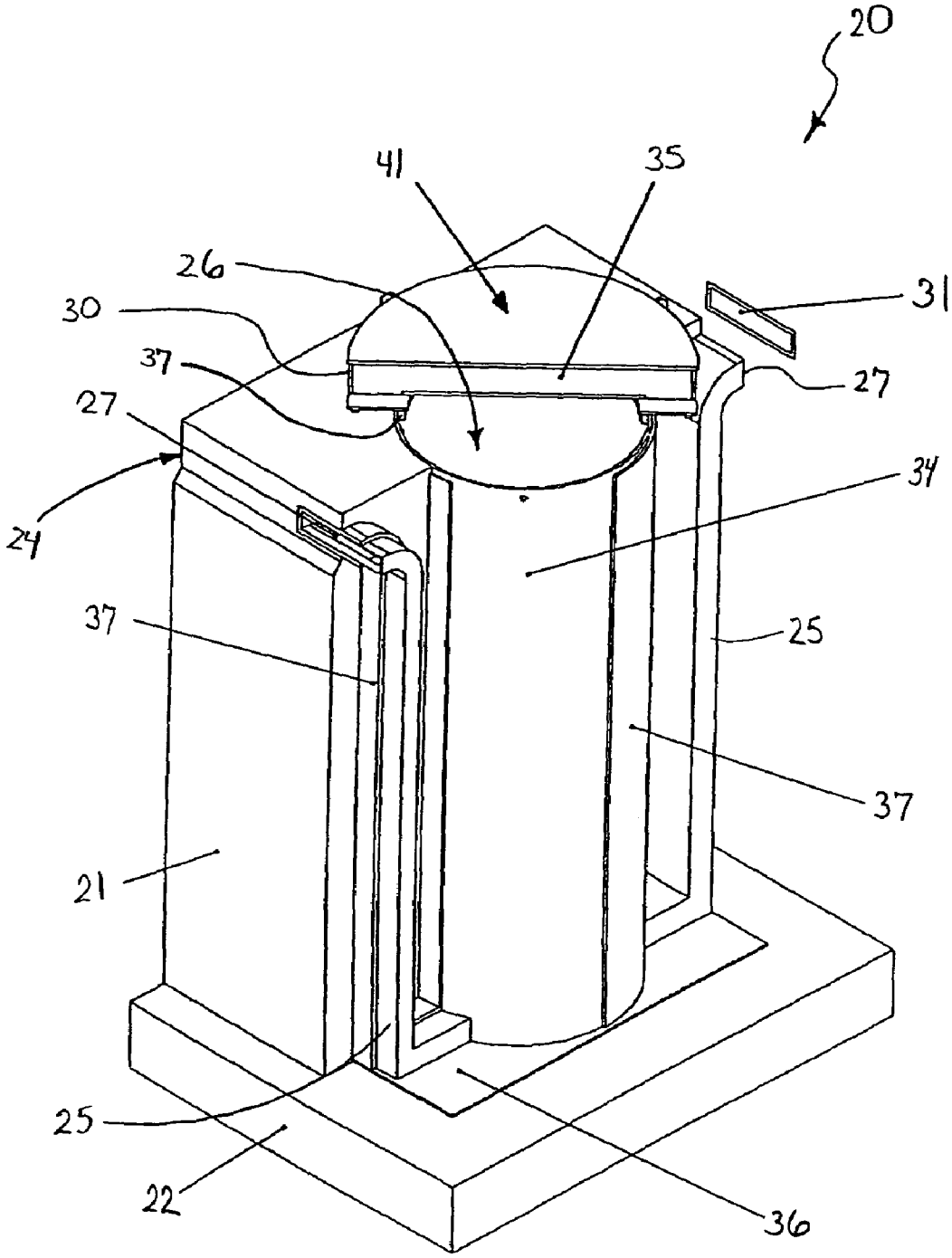
FIG. 3 is a perspective view of the underground VVO of FIG. 2 removed from the ground.

Referring now to FIGS. 2 and 3, underground VVO 20 is illustrated according to an embodiment of the present invention. Underground VVO 20 is a vertical, ventilated dry spent fuel storage system that is fully compatible with 100 ton and 125 ton transfer casks for spent fuel canister transfer operations. Underground VVO 20 is designed to accept spent fuel canisters for storage at an Independent Spent Fuel Storage Installation ("ISFSI") in lieu of above ground overpacks (such as prior art VVO 2 in FIG. 1). All spent fuel canister types presently certified for storage in free-standing and anchored overpack models can be stored in underground VVO 20.

Underground VVO 20 comprises body 21, base 22, and removable lid 41. Body 21 is constructed of concrete, but can be constructed of other suitable materials. Body 21 is rectangular in shape but can be any shape, such as cylindrical. A major portion of the height of body 21 is positioned below grade so that only top portion 24 of body 23 protrudes above gradelevel 23. Preferably, top portion 24 of body 21 extends approximately 6 to 36 inches above ground level 23.

Body 21 has cylindrical cavity 26 therein (best shown in FIG. 3). While cavity 26 is cylindrical in shape, cavity 26 is not limited to any specific size or shape and can be designed to receive and store almost any shape of canister without departing from the spirit of the invention.

Two inlet ventilation ducts 25 are provided in body 21 for providing inlet ventilation to the bottom of cavity 26. Inlet ventilation ducts 25 are an elongated substantially S-shaped passageway extending from above grade inlet 27 to below grade outlet 28. Above grade inlets 27 are located on opposing side walls of top portion 24 of body 21 and open to the ambient air above ground level 23. Below grade outlets 28 open into cavity 26 at or near its bottom at a position below ground level 23. Thus, inlet ventilation ducts 25 provide a passageway for the inlet of air to the bottom of cavity 26, despite the bottom of cavity 26 being below grade. Vent screens 31 (FIG. 3) are provided to cover above grade inlets 27 so that objects and other debris can not enter and block the passageways of inlet ventilation ducts 25. As a result of the elongated S-shape of inlet ventilation ducts 25, above grade inlets 27 cease to be a location of elevated dose rate that is common in free-standing above ground VVOs. Inlet ventilation ducts 25 have a rectangular cross section. However, inlet ventilation ducts 25 are not limited to any specific cross sectional shape or duct shape. The exact shape and cross-sectional configuration of the ducts is a matter of design preference. Inlet ventilation ducts 25 are preferably made of low carbon steel. However, inlet ventilation ducts 25 can be made of any material or can be mere passageways formed into concrete body 21 without a lining.

Support blocks 32 are provided on the bottom surface of cavity 26 so that canister 50 can be placed thereon. Support blocks 32 are circumferentially spaced from one another. When canister 50 is placed into cavity 26 for storage, the bottom surface of canister 50 rests on support bocks 32, forming an inlet air plenum 33 between the bottom surface of the canister and the bottom surface of cavity 26. Support blocks 32 are made of low carbon steel.

As best illustrated in FIG. 3, cavity 26 is formed by thick steel shell 34 and an integral steel bottom plate 36. Shell 34 and bottom plate are made of low carbon steel. Inlet ventilation ducts 25 are also made of low carbon steel and are seal welded to shell 34 and bottom plate 36 to form an integral piece that is hermetically sealed to the ingress of below grade water and other fluids. Thus, the only way water or other fluids can enter cavity 26 is through the above grade inlets 27 or the outlet ventilation ducts 42 in the lid 41.

Concrete body 21 surrounds shell 34 and inlet ventilation ducts 25. Body 21 provides non-structural protection for shell 34 and inlet ventilation ducts 25. Insulation 37 is provided at the interface between shell 34 and concrete body 21 and at the interface between inlet ventilation ducts 25 and concrete body 21. Insulation 37 is provided to prevent excessive transmission of heat decay from spent fuel canister 50 to concrete body 21, thus maintaining the bulk temperature of the concrete within FSAR limits. Insulating shell 34 and inlet ventilation ducts 25 from concrete body 21 also serves to minimize the heat-up of the incoming cooling air before it enters cavity 26.

Body 21 along with the integral steel unit formed by bottom plate 36, shell 34, and ventilation ducts 25 are placed atop base 22. Base 22 is a reinforced concrete slab designed to satisfy the load combinations of ACI-349. Base 22 is rectangular in shape but can take on any shape necessary to support body 21.

Underground VVO 20 has a removable ventilated lid 41. Lid 41 is positioned atop body 21, thereby substantially enclosing cavity 26 so that radiation does not escape through the top of cavity 26. Lid 41 has four outlet ventilation ducts 42. Outlet ventilation ducts 42 form a passageway from the top of cavity 26 to the ambient so that heated air can escape from cavity 26. Outlet ventilation ducts 42 are horizontal passageways that extend through side wall 30 of lid 41. Because outlet ventilation ducts 42 are located within lid 41 itself, the total height of body 21 is minimized.

Lid 41 comprises a roof 35 made of concrete. Roof 35 provides radiation shielding so that radiation does not escape from the top of cavity 26. Side wall 30 of lid 41 is an annular ring. When lid 41 is placed atop body 21 and spent fuel canister 50 is positioned in cavity 26, outlet air plenum 36 is formed between the top surface of canister 50 and lid 41. Outlet air plenum 36 helps facilitate the removal of heated air via outlet ventilation ducts 42. In order to minimize the heated air exiting outlet ventilation ducts 42 from being siphoned back into inlet ventilation ducts 25, outlet ventilation ducts 42 are azimuthally and circumferentially separated from inlet ventilation ducts 25.

Ventilated lid 41 also comprises shear ring 37. When lid 41 is placed atop to body 21, shear ring 37 protrudes into cavity 26, thus, providing enormous shear resistance against lateral forces from earthquakes, impactive missiles, or other projectiles. Lid 41 is secured to body 21 with bolts (not shown) that extend therethrough.

Figure 4:
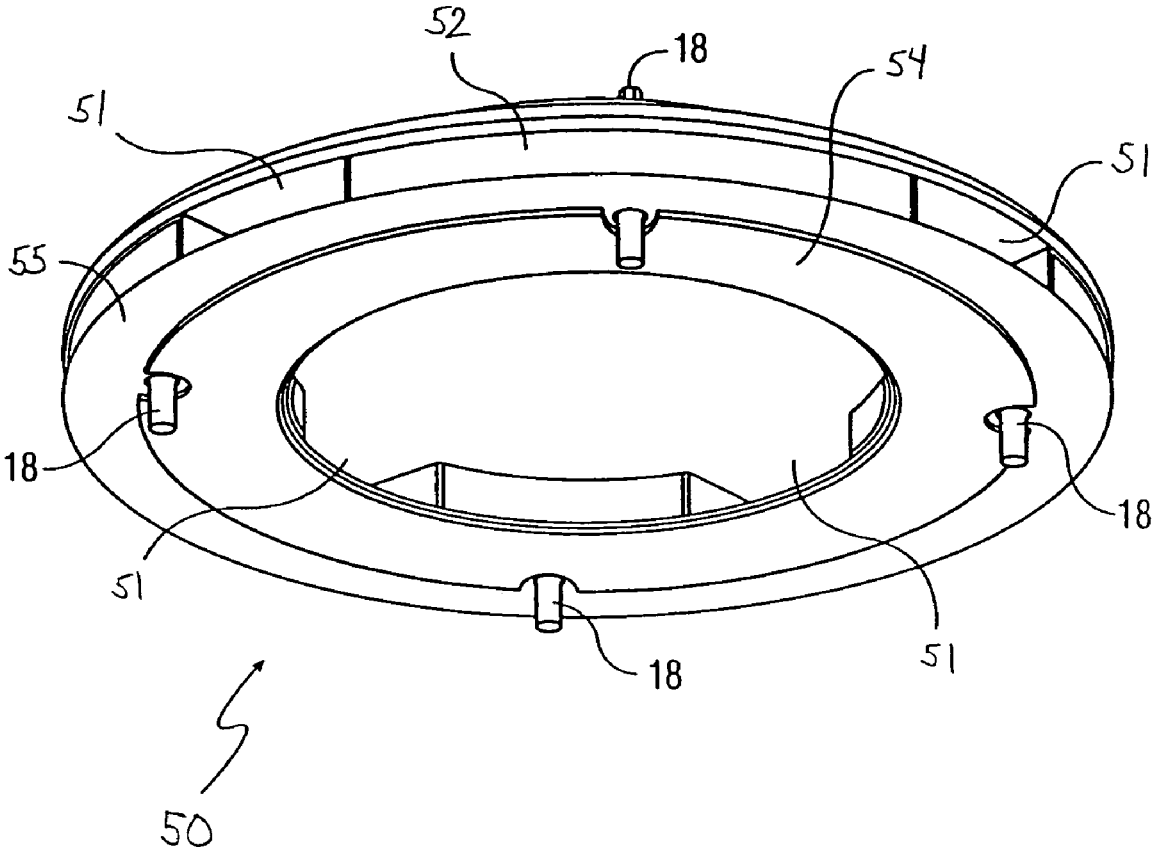
FIG. 4 is a bottom perspective view of an alternate embodiment of a lid to be used with the underground VVO of FIG. 2.

Referring now to FIG. 4, an alternative embodiment of a lid that can be used in underground VVO 20 is illustrated. Lid 50 contains similar design aspects as lid 41 and is illustrated to more fully disclose the aforementioned lid design aspects. Lid 50 has four horizontal outlet ventilation ducts 51 in side wall 52. Shear ring 54 is provided on the bottom of lid 50 to fit into cavity 26. Bolts 18 are used to secure lid 50 to bolt holes in the top of body 21.

While the outlet ventilation ducts are illustrated as being located within the lid of the underground VVO, the present invention is not so limited. For example, outlet ventilation ducts can be located in the body of the underground VVO at a location above grade.

Referring back to FIG. 2, soil 29 surrounds body 21 for almost the entirety of its height. When spent fuel canister 50 is positioned in cavity 26, a major portion, if not substantially all of the entire height of the canister 50 is below grade. Thus, soil 29 provides a degree of radiation shielding for spent fuel that is stored in underground VVO 20 that can not be achieved in above-ground overpacks. Underground VVO 20 is unobtrusive in appearance and there is no danger of underground VVO 20 tipping over. Additionally, underground VVO 20 does not have to contend with soil-structure interaction effects that magnify the free-field acceleration and potentially challenge the stability of an above ground free-standing overpack.

Figure 5:
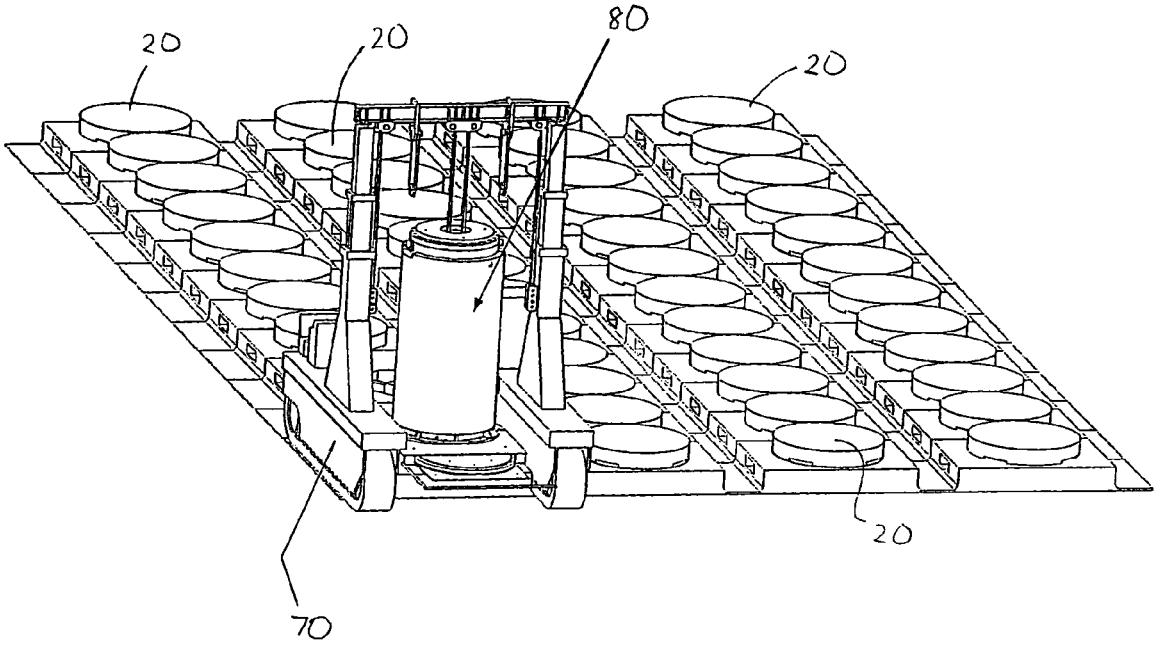
FIG. 5 is a perspective view of an array of underground VVO's according to an embodiment of the present invention

Referring now to FIG. 5, ISFIs can be designed to employ any number of underground VVOs 20 and can be expanded in number easily to meet growing needs. Although the underground VVOs 20 are closely spaced, the design permits any cavity to be independently accessed by cask crawler 70 with ease. The subterranean configuration of underground VVOs 20 greatly reduce the height of the stack structures created during loading/transfer procedures where a transfer cask 80 is positioned atop the underground VVO 20.

An embodiment of a method of using underground VVO 20 to store spent nuclear fuel canister 50 will now be discussed in relation to FIGS. 2–5. Upon being removed from a spent fuel pool and treated for dry storage, spent fuel canister 50 is positioned in transfer cask 80. Transfer cask is 80 is carried by cask crawler 70 to a desired underground VvO 20 for storage. In preparing the desired underground VVO 20 to receive canister 50, lid 41 is removed from body 21 so that cavity 26 is open. Cask crawler 70 positions transfer cask 80 atop underground VVO 20. After transfer cask is properly secured to the top of underground VVO 20, the bottom plate of transfer cask 80 is removed. Canister 50 is then lowered by cask crawler 70 from transfer cask 80 into cavity 26 of underground VVO 20 until the bottom surface of canister 50 contacts and rests atop support blocks 32, as described above.

When resting on support blocks 32, a major portion of the canister's height is below grade. Once canister 50 is positioned and resting in cavity 26, lid 41 is placed over cavity 26 substantially enclosing cavity 26. Lid 41 is oriented atop body 21 so that shear ring 37 protrudes into cavity 26 and outlet ventilation ducts 42 are azimuthally and circumferentially separated from inlet ventilation ducts 25 on body 21. Lid 41 is then secured to body 21 with bolts. As a result of the heat eminating from canister 50, cool air from the ambient is siphoned into inlet ventilation ducts 25 and into the bottom of cavity 26. This cool air is then warmed by the heat from the spent fuel in canister 50, rises in cavity 26 around canister 50, and then exits cavity 26 as heated air via outlet ventilation ducts 42 in lid 41.

While the invention has been described and illustrated in sufficient detail that those skilled in this art can readily make and use it, various alternatives, modifications, and improvements should become readily apparent without departing from the spirit and scope of the invention.

What is claimed is:

1. A system for storing spent nuclear fuel comprising:

a body having a cavity for receiving and storing a spent fuel canister, a major portion of the body positioned below grade;

the body containing at least one inlet ventilation duct extending from an above grade inlet to a below grade outlet, the below grade outlet being in spatial cooperation with the cavity;

a removable lid positioned atop the body and covering the cavity so as to form a lid-to-body interface, the lid and body being a non-unitary structure; and wherein the cavity has a cross-section that accommodates no more than one spent fuel canister.

2. The system of claim 1 wherein the above grade inlet is in a side wall of the body.

3. The system of claim 2 wherein the below grade outlet is at or near a bottom of the cavity.

4. The system of claim 3 wherein the inlet ventilation duct is an elongated substantially S-shape.

5. The system of claim 1 wherein the number of the inlet ventilation ducts in the body is two.

6. The system of claim 5 wherein the above grade inlets of the two inlet ventilation ducts are on opposing side walls of the body.

7. The system of claim 1 wherein at least a portion of the inlet ventilation duct is insulated from the body.

8. The system of claim 1 wherein at least a portion of the cavity is insulated from the body.

9. The system of claim 1 further comprising a shell lining the cavity.

10. The system of claim 1 further comprising a shell lining the cavity, wherein the inlet ventilation duct and the cavity are hermetically sealed to the ingress of below grade liquids.

11. The system of claim 10 wherein the shell and the inlet ventilation duct are made of steel, the shell and the inlet ventilation duct connected by welding.

12. The system of claim 11 further comprising a steel bottom plate integral to the shell and the inlet ventilation duct.

13. The system of claim 1 wherein the body is made of concrete.

14. The system of claim 1 further comprising means to support a canister on a bottom surface of the cavity, the support means providing an air plenum between a canister of spent nuclear fuel and the bottom surface of the cavity when the canister is placed in the cavity for storage.

15. The system of claim 14 wherein the support means are one or more support blocks.

16. The system of claim 15 wherein the support means are a plurality of circumferentially spaced support blocks.

17. The system of claim 16 wherein the support blocks are made of steel or another weldable metal.

18. The system of claim 1 wherein when a spent fuel canister is positioned in the cavity, an air plenum exists between the canister and the lid.

19. The system of claim 1 wherein the lid comprises a shear ring, the shear ring protruding into the cavity when the lid is positioned atop the body.

20. The system of claim 1 wherein the lid comprises at least one outlet ventilation duct for allowing heated air to exit the cavity.

21. The system of claim 20 wherein the outlet ventilation extends horizontally though a side wall of the lid.

22. The system of claim 21 wherein the outlet ventilation duct in the lid is circumferentially and azimuthally separated from the above grade inlet of the inlet ventilation duct in the body.

23. The system of claim 1 further comprising a base on which the body is positioned.

24. The system of claim 23 wherein the base is a concrete slab.

25. The system of claim 1 wherein approximately 6 to 36 inches of the body's height is above grade.

26. The system of claim 1 further comprising a vent screen covering the above grade inlet of the inlet ventilation duct.

27. The system of claim 1 wherein the cavity and the inlet ventilation duct are formed by an integral steel lining and the body is formed of concrete.

28. The system of claim 1 wherein a major portion of the cavity's height is below grade.

29. The system of claim 1 further comprising at least one outlet ventilation duct for allowing heated air to exit the cavity.

30. A system for storing spent nuclear fuel comprising:

a ground having a grade level;

a body having a cavity formed by an internal surface of the body, a major portion of the body positioned below grade;

the body containing at least one ventilation passageway extending from an above grade opening in an exterior surface of the body to a below grade opening in the interior surface of the body, the below grade opening being in spatial communication with the cavity;

a canister positioned in the cavity in a vertical orientation and adapted for dry storage of spent fuel; and wherein the cavity has a horizontal cross-section that accommodates no more than one canister.

31. The system of claim 1 further comprising no more than one spent fuel storage canister positioned in the cavity in a free-standing orientation, the canister adapted for dry storage of spent fuel.

32. The system of claim 31 wherein the canister is a transportable hermetically sealed canister containing the spent fuel.

33. The system of claim 1 wherein the system is a passive cooling system free of forced cooling equipment.

34. The system of claim 31 wherein the canister is a transportable hermetically sealed canister containing the spent fuel.

35. The system of claim 30 wherein the system is a passive cooling system free of forced cooling equipment.

* * * * *